US010182684B2

(12) United States Patent
Davis, Jr.

(10) Patent No.: US 10,182,684 B2
(45) Date of Patent: Jan. 22, 2019

(54) COMPOSITE SHOWER CURB AND SELF-SEALING CURB CAP

(71) Applicant: DAVIS INTELLECTUAL ASSETS, LLC., Savannah, GA (US)

(72) Inventor: Thomas A. Davis, Jr., Savannah, GA (US)

(73) Assignee: DAVIS INTELLECTUAL ASSETS, LLC, Savannah, GA (US)

( * ) Notice: Subject to any disclaimer, the term of this patent is extended or adjusted under 35 U.S.C. 154(b) by 345 days.

(21) Appl. No.: 14/599,657

(22) Filed: Jan. 19, 2015

(65) Prior Publication Data

US 2015/0128340 A1 May 14, 2015

Related U.S. Application Data

(63) Continuation-in-part of application No. 14/182,447, filed on Feb. 18, 2014.

(60) Provisional application No. 61/861,049, filed on Aug. 1, 2013, provisional application No. 61/766,315, filed on Feb. 19, 2013, provisional application No. 61/766,319, filed on Feb. 19, 2013.

(51) Int. Cl.
*A47K 3/40* (2006.01)
*E03F 5/04* (2006.01)

(52) U.S. Cl.
CPC ..... *A47K 3/40* (2013.01); *E03F 5/0408* (2013.01); *E03F 5/0409* (2013.01); *Y10T 29/49826* (2015.01); *Y10T 29/49947* (2015.01)

(58) Field of Classification Search
CPC ..... A47K 3/40; E03F 5/0408; E03F 5/0409
USPC ..... 4/613
See application file for complete search history.

(56) References Cited

U.S. PATENT DOCUMENTS

| | | | |
|---|---|---|---|
| 3,501,879 | A | 3/1970 | Mitchell et al. |
| 3,606,617 | A | 9/1971 | Frazier |
| 4,541,132 | A | 9/1985 | Long |
| 4,557,004 | A | 12/1985 | Piana |
| 5,778,464 | A | 7/1998 | Chapple et al. |
| 5,845,347 | A | 12/1998 | Young |
| 6,003,169 | A | 12/1999 | Davis, Jr. |
| 6,735,793 | B2 | 5/2004 | Peterson |
| 6,941,703 | B2 | 9/2005 | MacLean et al. |
| 6,990,695 | B2 | 1/2006 | Grayson |
| 7,007,315 | B2 | 3/2006 | Stonecipher |
| 7,296,309 | B2 | 11/2007 | Nehring |
| 7,632,401 | B2 | 12/2009 | Edelmayer |
| 7,694,358 | B2 | 4/2010 | Stimpson |
| 7,752,686 | B2 | 7/2010 | Polimeno |
| 7,979,927 | B2 | 7/2011 | Daniels |
| 8,028,353 | B1 * | 10/2011 | Hohmann, Jr. ..... B32B 5/32 156/325 |
| 8,181,287 | B2 | 5/2012 | Luxton |
| 8,230,535 | B2 | 7/2012 | Kik, Sr. et al. |

(Continued)

*Primary Examiner* — Christine Skubinna
(74) *Attorney, Agent, or Firm* — Gardner Groff Greenwald & Villanueva, PC

(57) ABSTRACT

A composite curb for a shower base, and a self-sealing anchoring cap for a shower curb. The composite curb includes a lower-density base portion formed of closed cell foam, and a higher-density anchoring cap portion attached to the base. The self-sealing anchoring cap comprises a resilient or self-healing material or a self-sealing layer, and is configured to retain a fastener therein and form a water-resistant seal between the fastener and the anchoring cap portion.

9 Claims, 14 Drawing Sheets

(56) References Cited

U.S. PATENT DOCUMENTS

| | | | | |
|---|---|---|---|---|
| 8,375,480 | B2 | 2/2013 | Cook | |
| 9,107,545 | B1 * | 8/2015 | Herring | A47K 3/40 |
| 2003/0089059 | A1 | 5/2003 | Kirby | |
| 2004/0181869 | A1 | 9/2004 | Cowling | |
| 2005/0028268 | A1 | 2/2005 | Hess | |
| 2007/0157538 | A1 | 7/2007 | DeGarmo | |
| 2008/0163420 | A1 | 7/2008 | Dieter et al. | |
| 2008/0276364 | A1 * | 11/2008 | Barro | A47K 3/40 4/613 |
| 2009/0235449 | A1 * | 9/2009 | Lin | A47K 3/40 4/613 |
| 2010/0071125 | A1 * | 3/2010 | Miller | A47K 3/40 4/613 |
| 2010/0146699 | A1 | 6/2010 | Stimpson | |
| 2010/0154112 | A1 * | 6/2010 | Goodhue | A47K 3/008 4/613 |
| 2011/0197354 | A1 | 8/2011 | Wedi | |
| 2013/0232682 | A1 * | 9/2013 | Geels | A47K 3/02 4/584 |

* cited by examiner

COMPOSITE SHOWER CURB AND SELF-SEALING CURB CAP

CROSS-REFERENCE TO RELATED APPLICATIONS

This application is a continuation-in-part of U.S. Non-Provisional patent application Ser. No. 14/182,447 filed Feb. 18, 2014, which claims the benefit of U.S. Provisional Patent Application Ser. No. 61/766,315 filed Feb. 19, 2013; U.S. Provisional Patent Application Ser. No. 61/766,319 filed Feb. 19, 2013; and U.S. Provisional Patent Application Ser. No. 61/861,049 filed Aug. 1, 2013; the entireties of which are hereby incorporated by reference herein.

TECHNICAL FIELD

The present invention relates generally to waterproof bases, curbs and shower pan inserts or drainage floor assemblies for shower stalls and the like, and more particularly to pre-made custom shower bases, curbs and inserts, and methods of fabrication and installation thereof.

BACKGROUND

Generally, there are two types of shower stalls, pre-made and custom fabricated stalls. Custom fabricated stalls are often utilized for home renovations when it is difficult to transport large building materials through home doorways. Custom fabricated stalls are also used for installations not having a "typical" or industry standard sized shower area. These stalls are often tiled for decorative and aesthetic appeal. Typically, when constructing a custom tiled shower stall, the stall area is pre-fitted with a waterproof liner, shower pan, or other water impermeable surface to prevent water from leaking from the stall. Generally, the decorative tiles are then set in mortar over the liner to form the interior wall of the stall. However, tiled shower stalls are known to leak for a variety of reasons.

One such reason for shower stall leaks stems from damage to the waterproof shower liner or membrane. For example, a hole or tear in the liner can occur during the installation of the tile, which can require an installer to start all over in constructing the custom shower stall. Other leaks occur from damage to the shower pan or liner caused by the settling of the house. Regardless of how the leaks are born, significant damage can occur to the structure of the house as a result of the water leaks. Such damage can be costly and time consuming to correct.

Another problem with existing custom shower stalls is the difficulty in connecting the water drain of a shower stall to a drainpipe in the floor of the house. Presently, custom-built shower basins typically utilize specialized drain plumbing to connect the two, which results in additional plumbing work, installation time, and cost.

Shower systems and drainage floor assemblies commonly utilize a raised curb or threshold to limit the spread of water across a floor area. Traditionally, a shower curb was formed from a wood base structure with tile or other water-resistant surface material applied thereon. Over time, however, water may migrate through the surface material and into the wood base. This commonly causes the wood base to swell, resulting in cracks in the tile or other surface material, and rotting of the wood base material. Water migration is all the more likely if anchors for mounting or supporting a shower partition or shower door are driven through the water-resistant surface material into the base material, which forms a penetration pathway for leakage.

Other base materials such as concrete, expanded foam blocks, and solid plastic blocks or synthetic wood products have been utilized for fabricating a shower curb, but have not been found fully satisfactory. Concrete cores are time consuming and expensive to produce, heavy and therefore not well suited to transport from a remote fabrication facility to a jobsite, and require special tools to drill and drive anchors into for mounting partitions or shower doors. Expanded foam blocks typically lack sufficient holding strength to retain anchors for mounting partitions or shower doors, and their exterior surface may not be compatible for adhesion by grout to apply a tile surface thereon. Solid plastic blocks or synthetic wood products can also be undesirably heavy and expensive.

Furthermore, the decorative tiles or other walking surfaces or flooring in bathrooms and showers are typically wet and slippery, which commonly cause slips and falls, sometimes leading to injuries. The flooring in such areas is commonly sloped for drainage, and often uses hard and unforgiving surface materials, often increasing the likelihood of a fall and/or the likelihood of sustaining an injury from a fall.

Thus it can be seen that needs exist for improvements to custom-built shower bases to prevent water from leaking from the shower stall in combination with an improved base structure for forming a shower curb and an improved shower pan insert. It can also be seen that needs exist for shower bases that allow a direct, reliable and universal connection between the shower drain and the interior plumbing of a house, in combination with an improved base structure including a composite shower curb assembly and an improved shower pan insert. It is to the provision of an improved shower base with composite curb and an improved shower pan or drainage floor assembly meeting these and other needs that the present invention is primarily directed.

SUMMARY

The shower base of the present invention can be used for both residential and commercial tile shower applications. The shower base can be used in place of typical known sloped liner and mortar tile shower bases. A curb is provided along at least one side of the shower base. Each shower base can be manufactured to the exact specifications of a user's shower stall area as determined by a user or installer, including the location of the user's drain. The shower base is manufactured via a process by which the base has a substantially greater waterproofing ability than with known shower bases.

In one aspect, the present invention relates to a composite shower curb for positioning along at least one side of a shower base. The composite shower curb preferably includes a lower density base portion and a higher-density anchoring cap portion, the base portion comprising a light-weight expanded foam body defining a height and a width, and the anchoring cap portion comprising a fastener retaining material and having a width substantially matching the width of the base portion, the anchoring cap portion being substantially permanently attached to the foam body of the base portion.

In another aspect, the present invention relates to a composite shower curb for positioning along at least one side of a shower base. The curb preferably includes a base portion, an anchoring cap portion, and a self-sealing layer sandwiched between the base portion and the anchoring cap portion, the base portion comprising a lower density body defining a height and a width, and the anchoring cap portion comprising a higher-density fastener retaining material and having a width substantially matching the width of the base portion.

In still another aspect, the present invention relates to an anchoring cap for a shower curb, the anchoring cap comprising a fastener retaining material configured to retain a fastener therein and form a water-resistant seal between the fastener and the anchoring cap portion.

In another aspect, the present invention relates to a waterproof base providing connection between a tile drain and a drainpipe. The shower base includes an expanded polymer core defining a top surface and a bottom surface, the top surface sloping toward a drain opening extending through the polymer core from the top surface to the bottom surface, and further comprising a drain receiving recess in the top surface and extending at least partially through the expanded polymer core surrounding the drain opening. The shower base also includes a waterproof top layer applied over the top surface of the expanded polymer core, and a bottom skin applied to the bottom surface of the expanded polymer core at least around the drain opening.

In example forms, the shower base also includes a curb along at least one side of the expanded polymer core. The curb includes a base portion and a high-density anchoring cap portion, the base portion including a lightweight expanded foam body defining a height and a width, and the high-density anchoring cap portion including a fastener retaining material and having a width substantially matching the width of the base portion, the high-density anchoring cap portion being substantially permanently attached to the lightweight expanded foam body of the base portion. In one form, the lightweight expanded foam body includes a closed-cell foam having expanded polystyrene. The high-density anchoring cap portion can include a material selected from polyethylene, polyvinylchloride, polypropylene, acrylonitrile-butadiene-styrene, fiberboard, foamed PVC board, foam backer board and combinations thereof. Optionally, a sealant is applied over external surfaces of at least the base portion. Preferably, the sealant is compatible with a thinset adhesive grout. Further optional, at least one fastener is included for retention by the high-density anchoring cap portion.

In another aspect, the invention relates to a curb for positioning along at least one side of a shower base. In example forms, the curb includes a base portion and a high-density anchoring cap portion. The base portion includes a lightweight expanded foam body defining a height and a width, and the high-density anchoring cap portion includes a fastener retaining material and having a width substantially matching the width of the base portion. In example forms, the high-density anchoring cap portion is substantially permanently attached to the lightweight expanded foam body of the base portion.

In example forms, the curb further includes a self-sealing member positioned between the base portion and the high-density anchoring cap portion. In one example form, a side of the high-density anchoring cap portion is substantially permanently attached to a first side of the self-sealing member, and wherein a side of the base portion is substantially permanently attached to a second side of the self-sealing member, thereby substantially permanently attaching the high-density cap portion to the base portion.

In another aspect, the invention relates to a curb for positioning along at least one side of a shower base, the curb includes a base portion, a high-density anchoring cap portion, and a self-sealing member sandwiched therebetween. The base portion includes a lightweight expanded foam body defining a height and a width, and the high-density anchoring cap portion includes a fastener retaining material and having a width substantially matching the width of the base portion. In example forms, the high-density anchoring cap portion is substantially permanently attached to the lightweight expanded foam body of the base portion, whereby a bottom side of the high-density anchoring cap portion is substantially permanently attached to a first side of the self-sealing member, and whereby a top side of the base portion is substantially attached to a second side of the self-sealing member.

In yet another aspect, the invention relates to a high-density cap for placement atop a base portion of a curb that is positioned along at least one side of a shower base. In example forms, the high-density cap includes a fastener retaining material having a top side, a bottom side, and a width substantially matching the width of the base portion. Preferably, the high-density cap further includes a self-sealing member substantially permanently attached to the bottom side thereof.

In example forms, the self-sealing member is formed from a rubber-like polyurethane sealant. Optionally, the self-sealing member is formed from a rubber flashing material. In one example form, the high-density anchoring cap portion includes a material selected from polyethylene, polyvinylchloride, polypropylene, acrylonitrile-butadiene-styrene, fiberboard, foamed PVC board, foam backer board and combinations thereof.

In another aspect, the invention is a method of fabricating a shower base. The method preferably includes the step of forming an expanded polymer core to define a top surface and a bottom surface, the top surface sloping toward a drain opening extending through the polymer core from the top surface to the bottom surface, and further including a drain receiving recess in the top surface and extending at least partially through the expanded polymer core surrounding the drain opening. The method preferably also includes applying a waterproof top layer over the top surface of the expanded polymer core, and applying a bottom skin to the bottom surface of the expanded polymer core at least around the drain opening.

In example forms, the fabrication method also includes installing a composite curb along at least one side of the expanded polymer core. The composite curb includes a base portion and a high-density anchoring cap portion, the base portion including a lightweight expanded foam body defining a height and a width, and the high-density anchoring cap portion including a fastener retaining material and having a width substantially matching the width of the base portion, the high-density anchoring cap portion being substantially permanently attached to the lightweight expanded foam body of the base portion. In one form, the fabrication method also includes installing a sealing material across the interface between the expanded polymer core and the composite curb. The fabrication method further includes installing tile over at least a portion of the composite curb. The fabrication method also includes mounting a structural component to the composite curb by at least one fastener retained by the high-density anchoring cap portion.

In another aspect, the invention is a method of installing a waterproof base. The method preferably includes the step of providing an assembly comprising an expanded polymer core defining a top surface and a bottom surface, the top surface sloping toward a drain opening extending through the polymer core from the top surface to the bottom surface, and further including a drain receiving recess in the top surface and extending at least partially through the expanded polymer core surrounding the drain opening. The drain receiving recess preferably defines an annular surface directed toward the top surface to define an upper drain clamping surface. The assembly preferably further includes a waterproof top layer applied over the top surface of the expanded polymer core, and a bottom skin applied to the bottom surface of the expanded polymer core at least around the drain opening. The method preferably further includes placement of the assembly onto a substrate, with the drain opening aligned with a lower drain element in the substrate, and attaching an upper drain element against the drain clamping surface of the drain receiving recess of the assembly and in engagement with the lower drain element. The method preferably further includes installation of a composite shower curb core along at least one side of the shower base, and installing tile or other surface covering material(s) over the base and curb to form an integrated shower containment system.

In another aspect, the present invention relates to a cushioned shower pan or drainage floor assembly for use in a shower, bathroom or other area from which water or other liquids are to drain. The cushioned shower pan or drainage floor assembly can be used with or in place of known sloped shower base assemblies with tile or other hard surface materials. The cushioned shower pan or drainage floor assembly can be manufactured in standard sizes, and/or manufactured to the exact specifications of a user's shower or bathroom area as determined by a user or installer, including the location of the user's drain, the shower dimensions, the slope, thickness, degree of resilience, etc.

In example forms, the present invention relates to a cushioned drainage assembly, also referred to as a shower base, shower pan insert or drainage floor panel. The cushioned drainage assembly generally includes an expanded poly-styrene (EPS) or other substantially rigid foam core having a surface sloped toward a drain or drain opening formed through the foam core, and a resilient cushioning surface layer of foam, rubber, neoprene or other soft water-resistant material(s), laminated or otherwise attached to the sloped core. The sloped core generally includes a top side, a bottom side and a drain hole. The cushioning layer attaches to the top side of the sloped core. Optionally, an upright perimeter flange may be secured around all or a portion of the perimeter of the drainage assembly.

In another aspect, the invention relates to cushioned drainage floor assembly including a closed-cell foam core and a compressible soft material layer applied over the closed-cell foam core.

In still another aspect, the invention relates to method of installing a drainage floor, the method including preparing a subfloor surface, applying a closed-cell foam core over the prepared subfloor surface, and applying a compressible soft material layer over the closed-cell foam core.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1A:
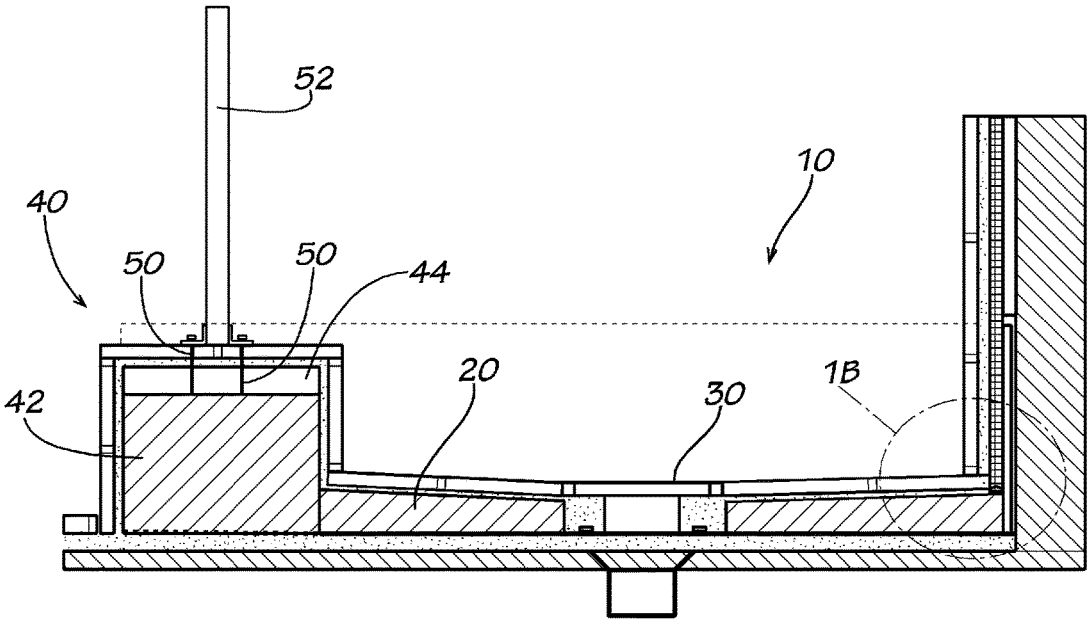
FIG. 1A is a side view of a shower base with a curb according to an example embodiment of the present invention.
Figure 1B:
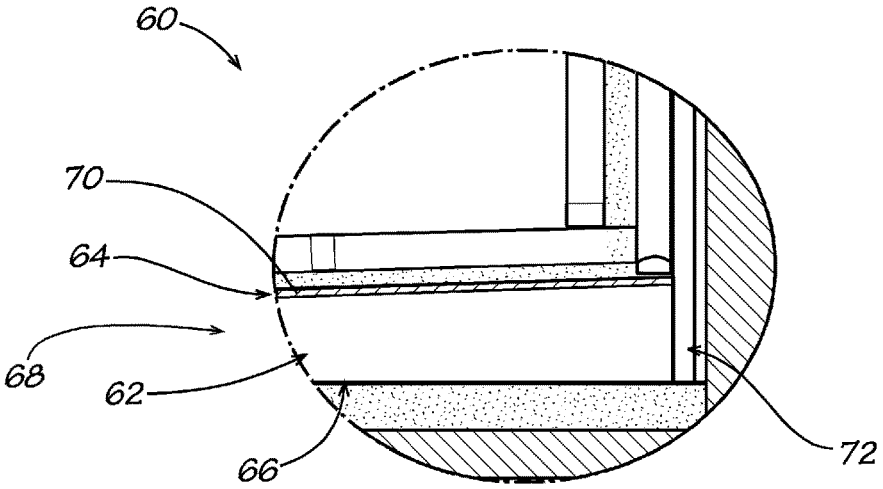
FIG. 1B is a close up view of the several layers comprising the shower base of FIG. 1A.

With reference now to the drawing figures, FIGS. 1A and 1B show a "tile-ready" shower base 10 according to an example embodiment of the present invention. The shower base 10 of the present invention can be used for both residential and commercial tile shower applications. The shower base 10 can be used in place of typical known sloped liner and mortar tile shower bases. Each shower base 10 can be custom manufactured to the exact specifications of a user's shower stall area as determined by a user or installer, including the location of the user's drain, or can be fabricated in one or more standard size formats. The shower base 10 is manufactured via a fabrication process and installed via an installation process, each discussed herein, by which the base has a substantially greater waterproofing ability than previously known shower bases. In example forms, the shower base 10 generally comprises a sloped basin 20, at least one drain 30, and a raised curb or threshold 40.

The shower basin 20 is fabricated as an assembly 60 of multiple layers, as shown in greater detail in FIG. 1B, which are coupled together into a unitary component through a unique manufacturing process that creates an exceptionally strong and long lasting waterproof surface. The assembly is preferably factory-fabricated, and delivered to a remote installation site for installation. When fully constructed, the basin has a graded slope towards the drain 30. It is preferred that the minimum amount of slope is about 0.25 inches/foot, but other slopes can be utilized as desired by a user.

In example embodiments, a core layer 62 of the basin 20 is formed from expanded polystyrene foam, polypropylene structural honeycomb thermoplastic, foam, rubber, plastics, wood, metals, or other solid or porous formable structural material(s). The core 62 is contoured to accommodate the desired slope of the basin. The core 62 is sandwiched between two waterproof panels or sheets 64, 66 of acrylic, thermoplastic, or other waterproof panel materials such as for example, PLAS-TEX® (manufactured by Parkland Plastics), CORIAN®, or POLYCOMP®. In an example embodiment, the waterproof top layer is a fiberglass mesh and epoxy resin top coat 64, and the waterproof bottom layer is a waterproof skin applied around the drain area. An adhesive such as for example, GORILLA GLUE®, is preferably applied between the waterproof panels 64, 66 and the core 62; and a membrane press, or other pressure applying method or apparatus, can be used to press the panels and core together. The assembly resulting from the combination of the waterproof panels 64, 66 and the core 62 is referred to as the sloped sandwiched blank ("SSB") 68.

Once the SSB 68 is completed, a layer of crack isolation material 70 is optionally applied to the sloped (top) surface of the SSB to prevent and/or contain any cracks that may develop in the SSB 68. In example embodiments, the crack isolation material 70 comprises a polyester, such as the material sold under the tradename FLEX-GUARD®. The crack isolation material 70 allows for expansion and contraction between the SSB 68 and the material (typically tile) applied over the SSB. In alternate example embodiments, as will be described below, a cushion layer can optionally be applied over the SSB 68.

After application of the crack isolation material 70, the SSB 68 receives a fiberglass/PLAS-TEX® flange 72 that surrounds the perimeter of the SSB. In example embodiments, the flange 72 is about 5 inches in height, but the height of the flange can vary as desired. It is preferred that the flange 72 be secured to the SSB 68 with silicone adhesive, although other types of adhesives can be applied. After the flange 72 has been secured to the SSB 68, the exterior of the basin 20 is encapsulated with fiberglass cloth and saturated with polyester fiberglass resin. Optionally, a bead joint of adhesive is applied to the joint between the flange 72 and SSB 68 for further waterproofing. The flange 72 is preferably thin, for example about 0.25" or less, to permit the shower's tile wall backerboard to extend over the flange to the sloped top surface of the shower base, for leak prevention and ease of installation. Once installed in the appropriate location, the basin 20 is ready to receive tile. U.S. Pat. No. 8,181,288 is incorporated herein by reference.

Figure 2:
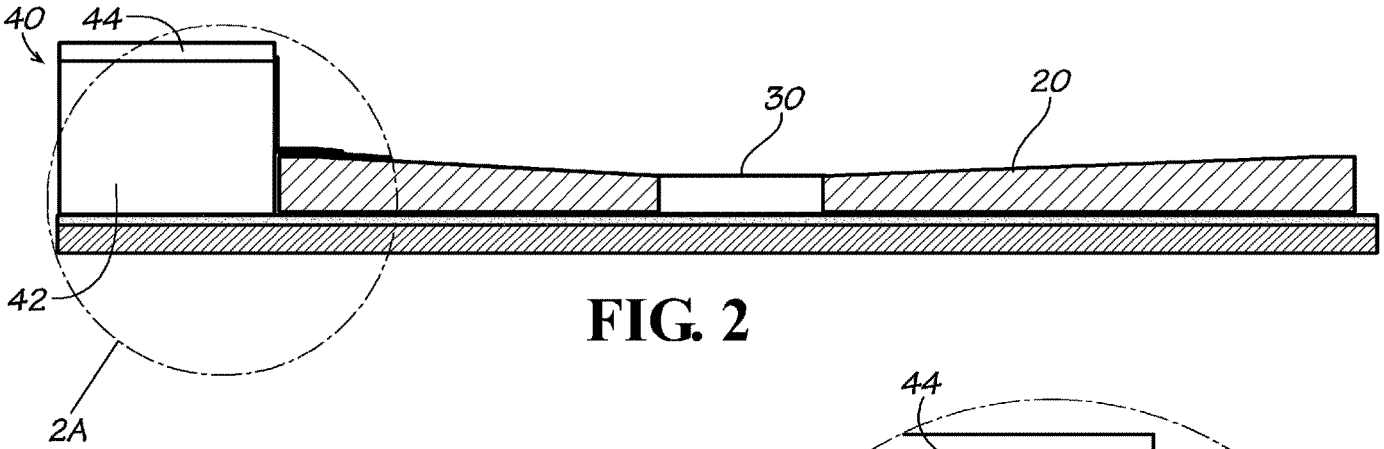
FIG. 2 is a side cross-sectional view of the shower base with the curb of FIG. 1A.
Figure 2A:
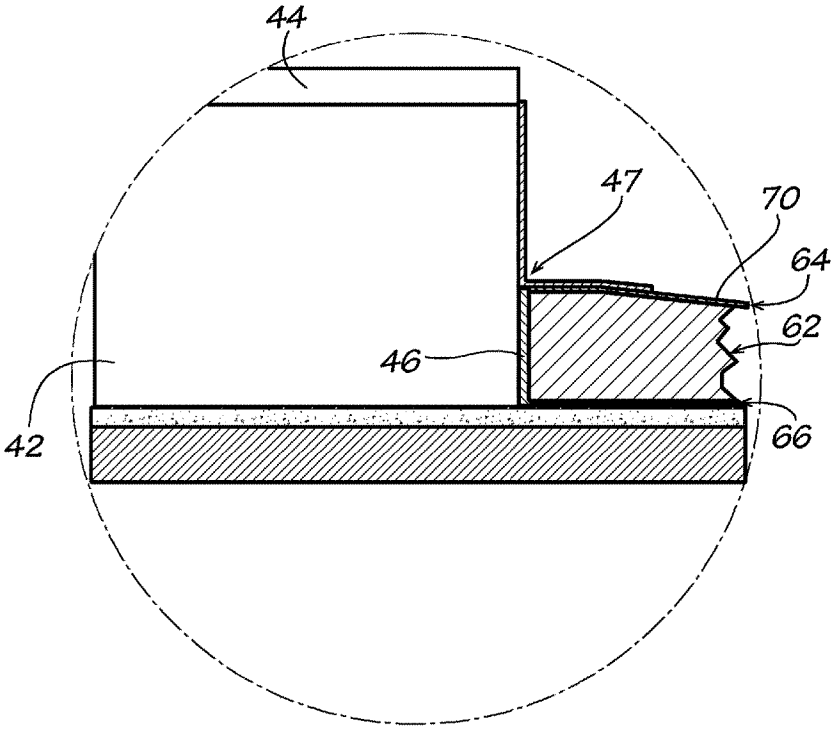
FIG. 2A is a detailed cross-sectional view of the threshold area of the shower curb and base assembly of FIG. 2, over which tile or other surface material can be applied.
Figure 3:
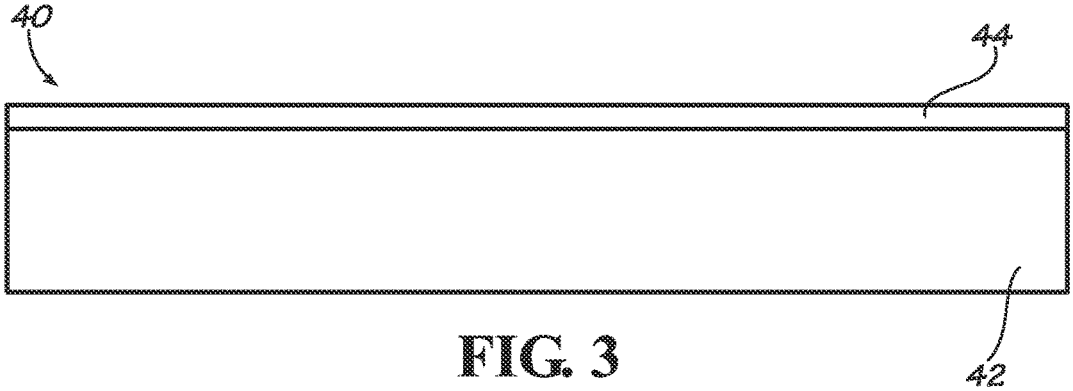
FIG. 3 is a side cross-sectional view of the curb of FIGS. 1A and 2.
Figure 3A:
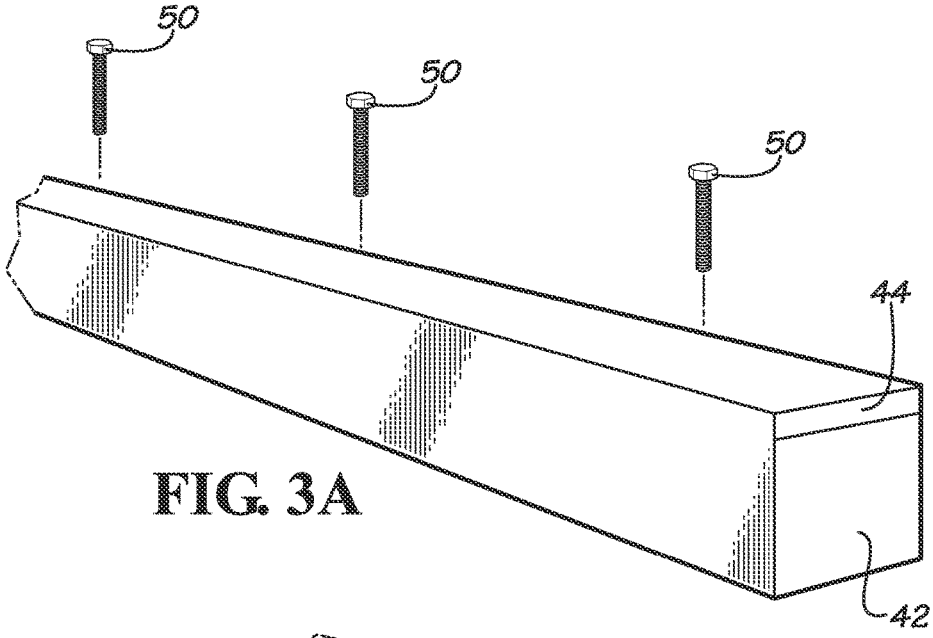
FIG. 3A is a perspective view of the curb of FIG. 3.

As seen in FIGS. 1A, 2 and 3, the curb 40 is applied to the basin 20. Typically, the curb 40 is positioned along the length of the entry point for a user to enter the basin area, or otherwise positioned along at least a portion of the periphery of the basin 20, which may result in it being positioned along two or more sides of the basin 20. Generally, the curb 40 is a composite body comprising a core or base portion 42 and a cap or anchoring portion 44. The base portion 42 and the anchoring portion 44 are attached to one another by adhesive, solvent welding, laminating, or other substantially permanent attachment means. The curb 40 is manufactured in a similar process as the basin 20, except that the curb typically includes a much thicker core 42, as seen in the drawing figures. The curb 40 preferably comprises a generally rectangular prismatic body having a generally square or rectangular cross-sectional profile of, for example, about 4" wide by about 4" high, and can be fabricated in various stock lengths and/or cut to custom length for a particular application. In alternate embodiments, the dimensions of the curb may vary depending on the intended application.

The base portion 42 of the curb 40 comprises an expanded polystyrene (EPS) closed-cell foam material or other lightweight and water-resistant or waterproof material. In alternate forms, the base portion 42 can comprise other expanded synthetic materials having an open or closed cell configuration. The base portion 42 preferably comprises a generally rectangular prismatic body having a generally rectangular cross-sectional profile of, for example, about 4" wide by about 3½" high.

The anchoring cap portion 44 of the curb is formed from a high-density plastic material, such as for example polyethylene (HDPE), polyvinylchloride (PVC), polypropylene (PP), acrylonitrile-butadiene-styrene (ABS), fiberboard, foamed PVC board, foam backer board, or other water-resistant or waterproof material having sufficient hardness and density to resist pull-out of a screw or other anchor and to support the load of a typical shower door or enclosure panel. The anchoring cap portion 44 can be formed as a solid or hollow body having a cross-sectional profile of, for example, about 4" wide by about ½" high, the width of the anchoring cap portion 44 preferably substantially matching the width of the base portion 42 such that their side edges align when assembled and form an integral body having a substantially continuous external surface.

The base portion 42 and the anchoring cap portion 44 can be secured together by adhesives, glues, fasteners, or the like. Optionally, mounting hardware or other elements may be embedded within the anchoring cap 44 and/or the base 42 wherein interengaging fasteners may be provided to secure a shower enclosure or other supported structure 52 thereto (as will be described below). A water-resistant or waterproof coating or sealant layer may optionally be applied over the curb 40, such as for example an elastomeric membrane, acrylic coating, or a latex-based waterproof paint or coating, to which thin-set or other adhesive or mortar will adhere.

Figure 3B:
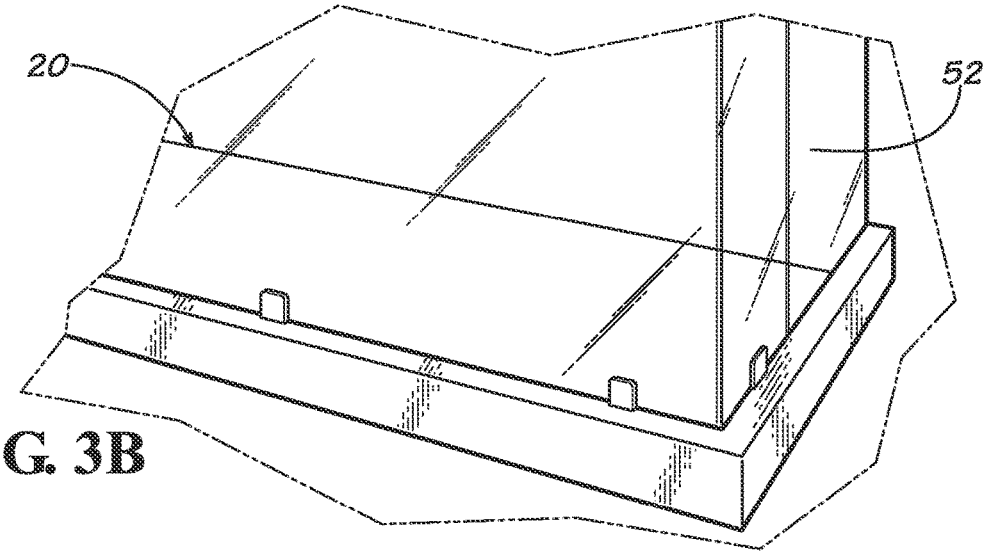
FIG. 3B is a perspective view of a shower area including a shower basin, a shower curb, and a shower enclosure mounted to the curb according to another example embodiment of the present invention.
Figure 4:
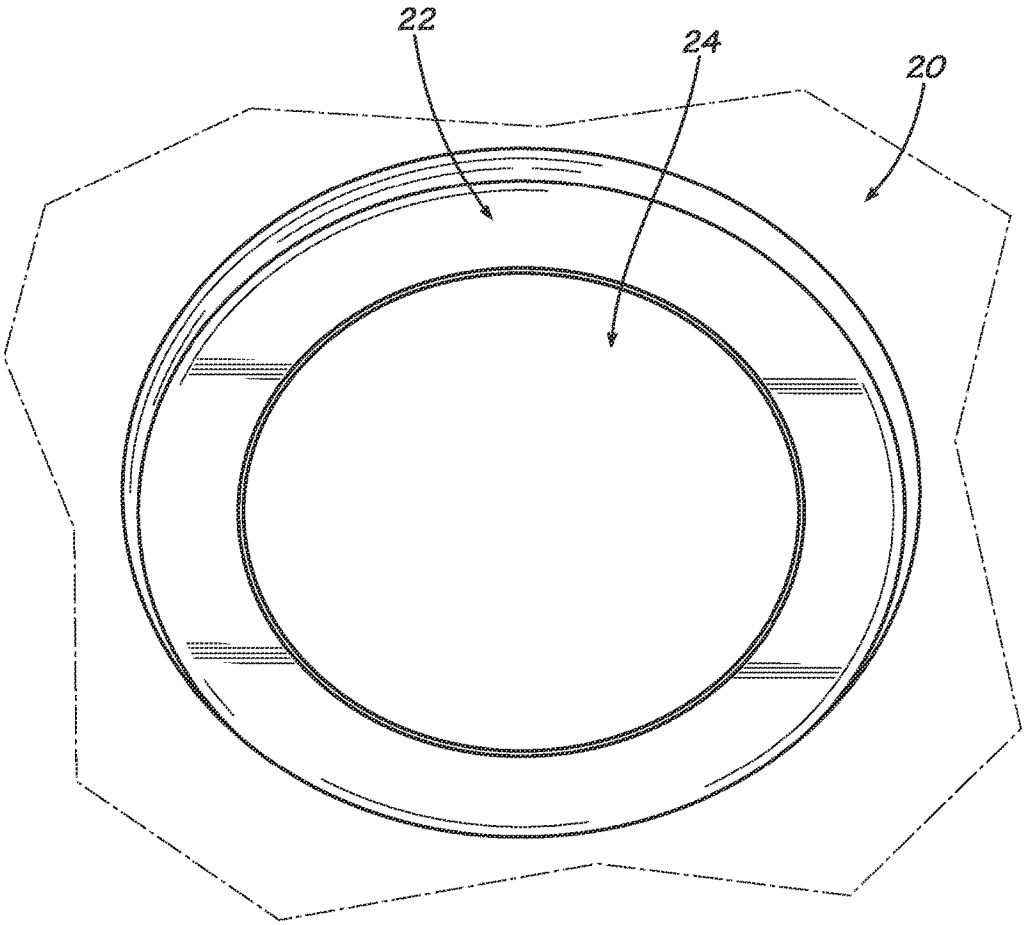
FIG. 4 is a perspective view of the drain hole of the shower base of FIG. 1.
Figure 5:
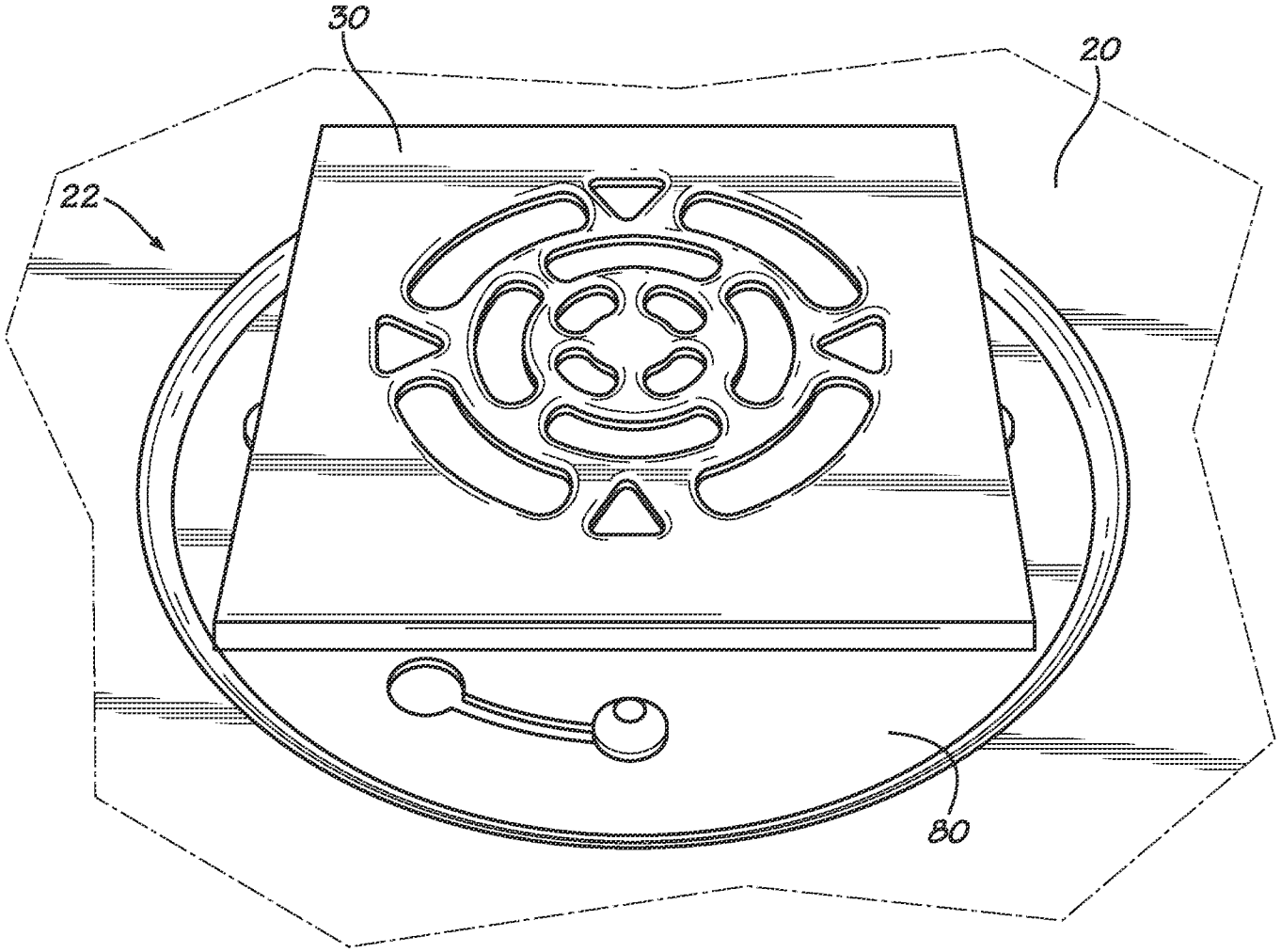
FIG. 5 is a perspective view of the drain hole of FIG. 4, shown with a shower drain mounted therein.
Figure 6:
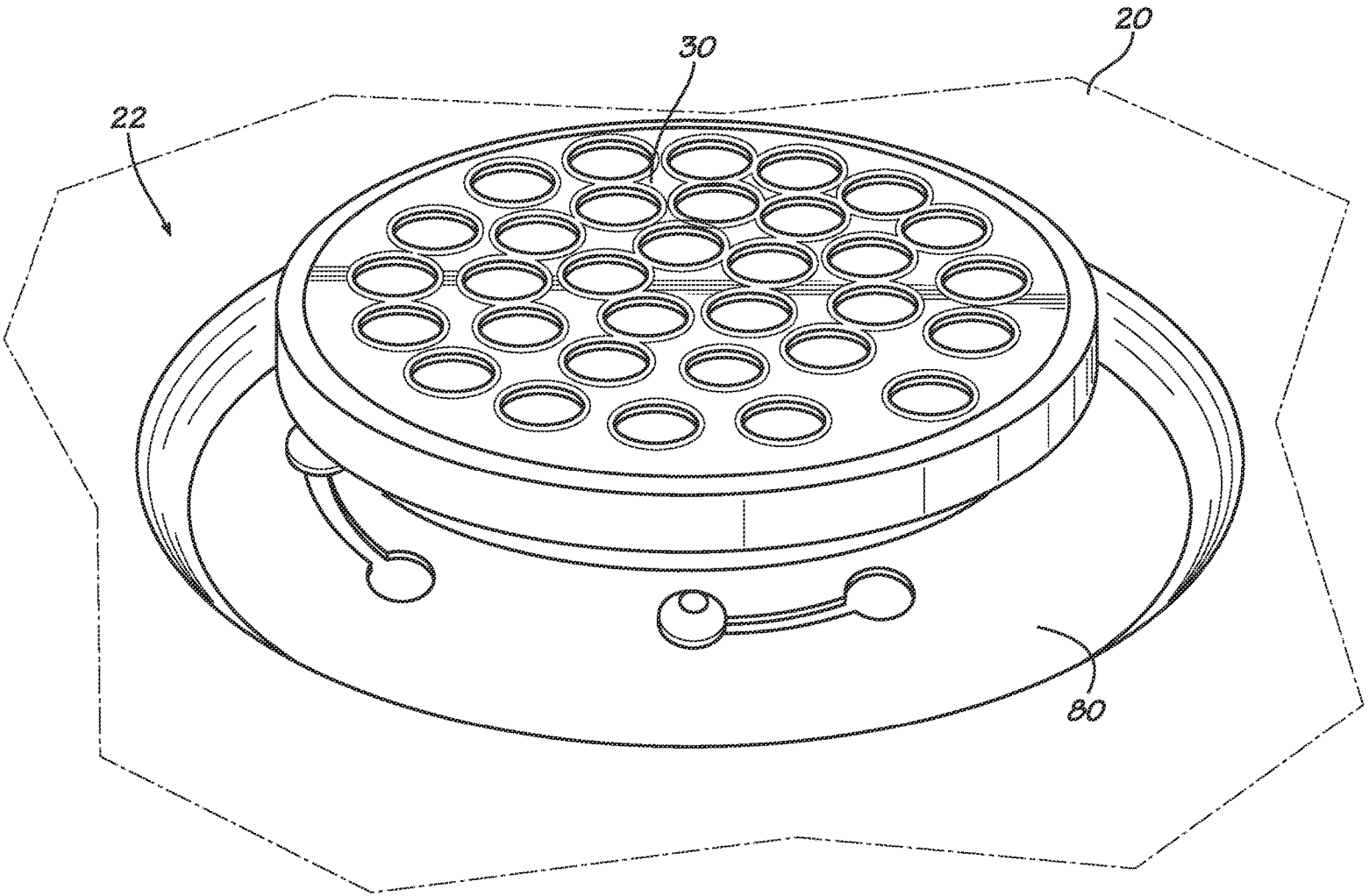
FIG. 6 is a perspective view of the drain hole of FIG. 4, shown with another shower drain mounted therein.
Figure 7B:
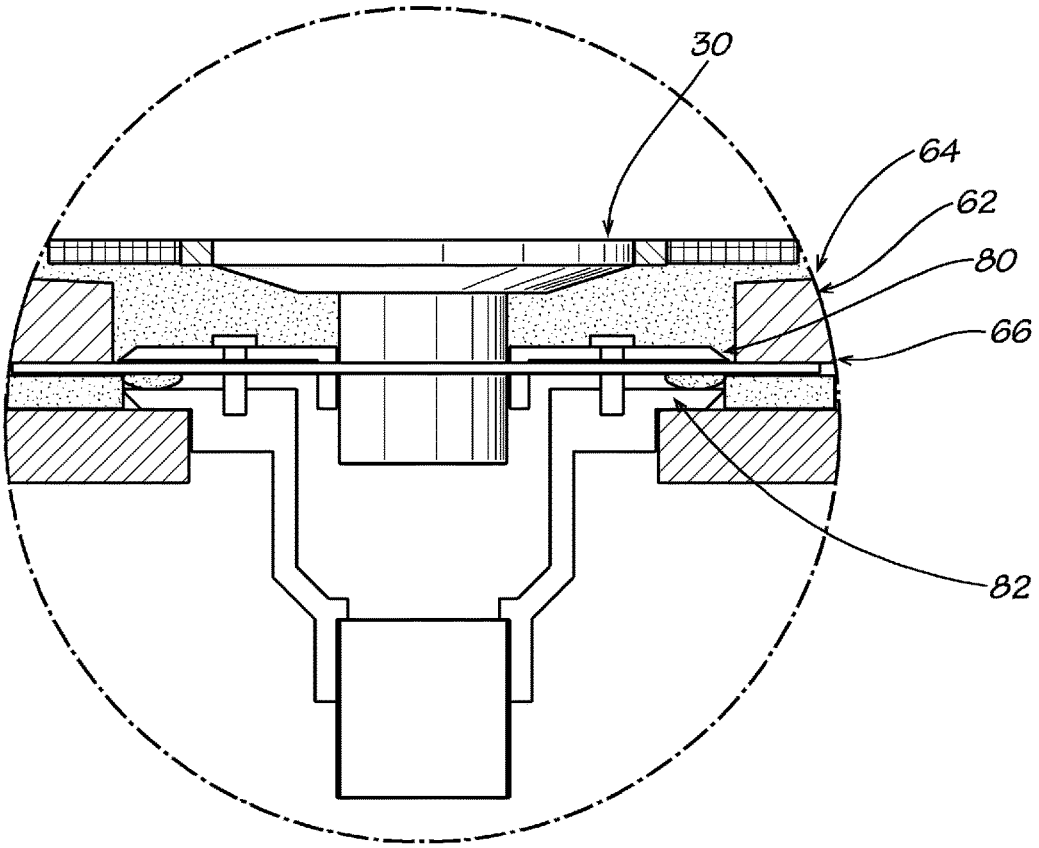
FIG. 7B is a close up view of the drain connection area of FIG. 7A.
Figure 7A:
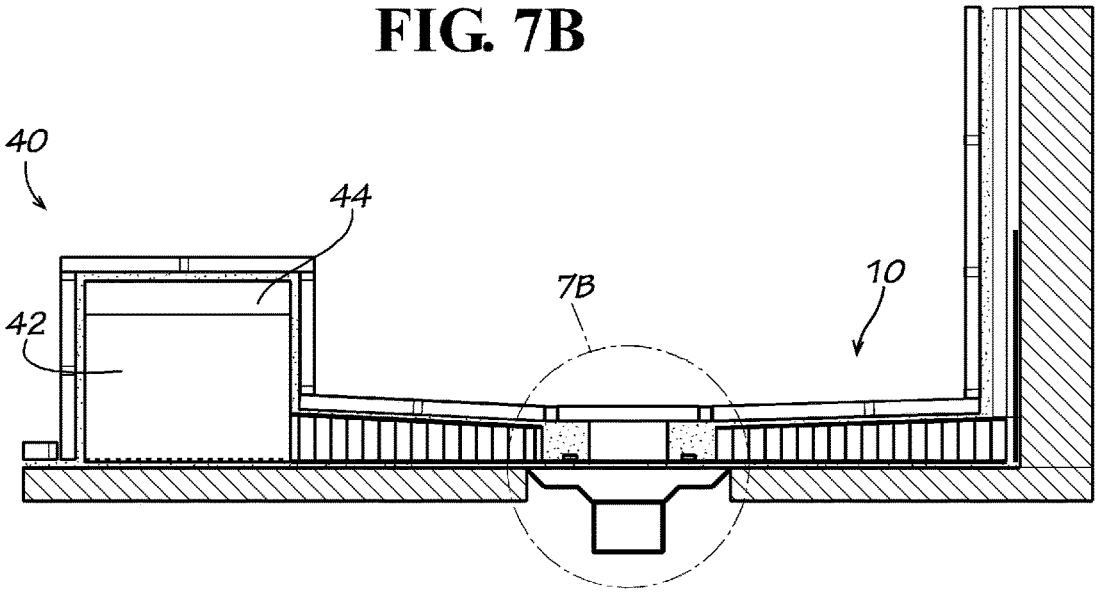
FIG. 7A is a side view showing further detail of the drain connection for the shower base of FIG. 1.
Figure 8:
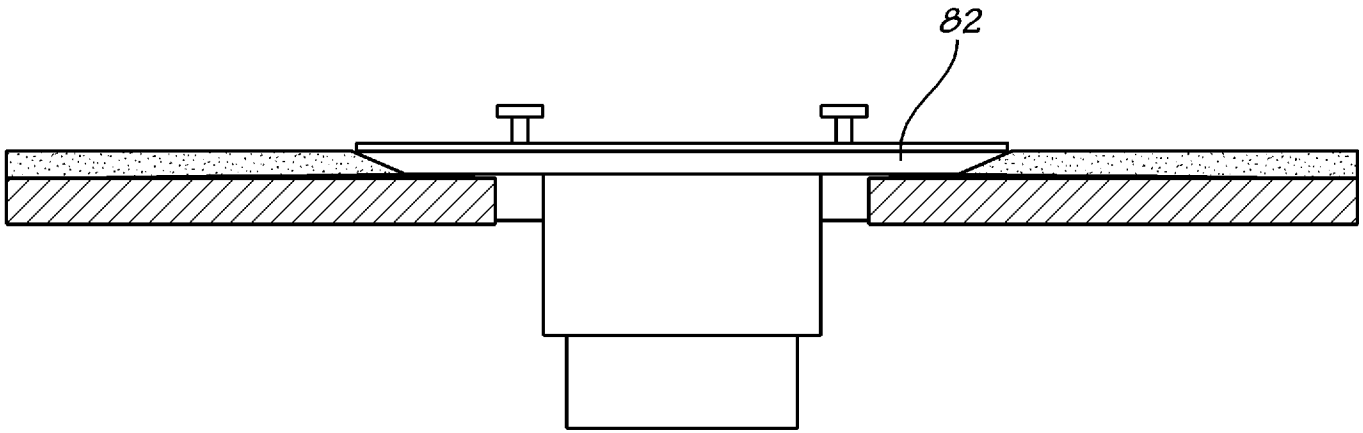
FIGS. 8-10 show a sequence of installation of the shower base according to an example form of the present invention.
Figure 9:
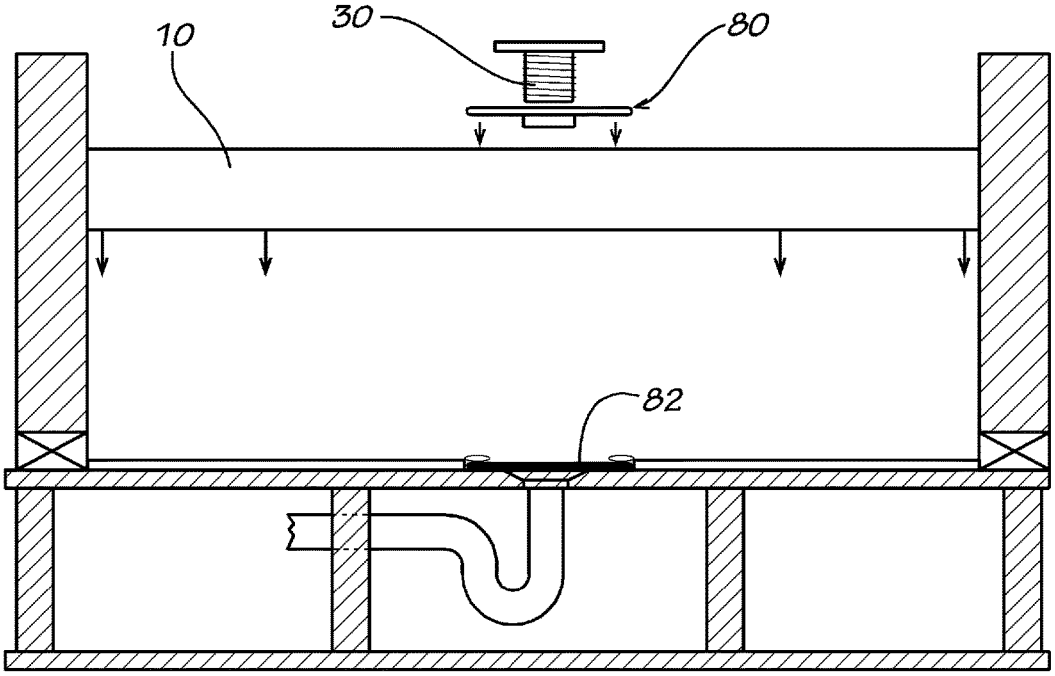
Figure 9A:
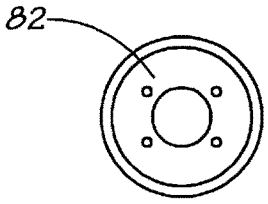
Figure 9B:
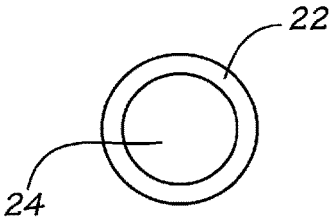
Figure 9C:
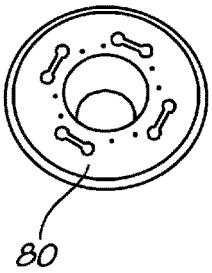
Figure 9D:
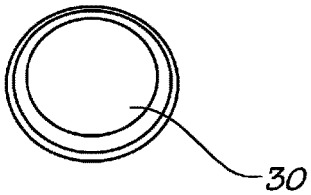
Figure 10:
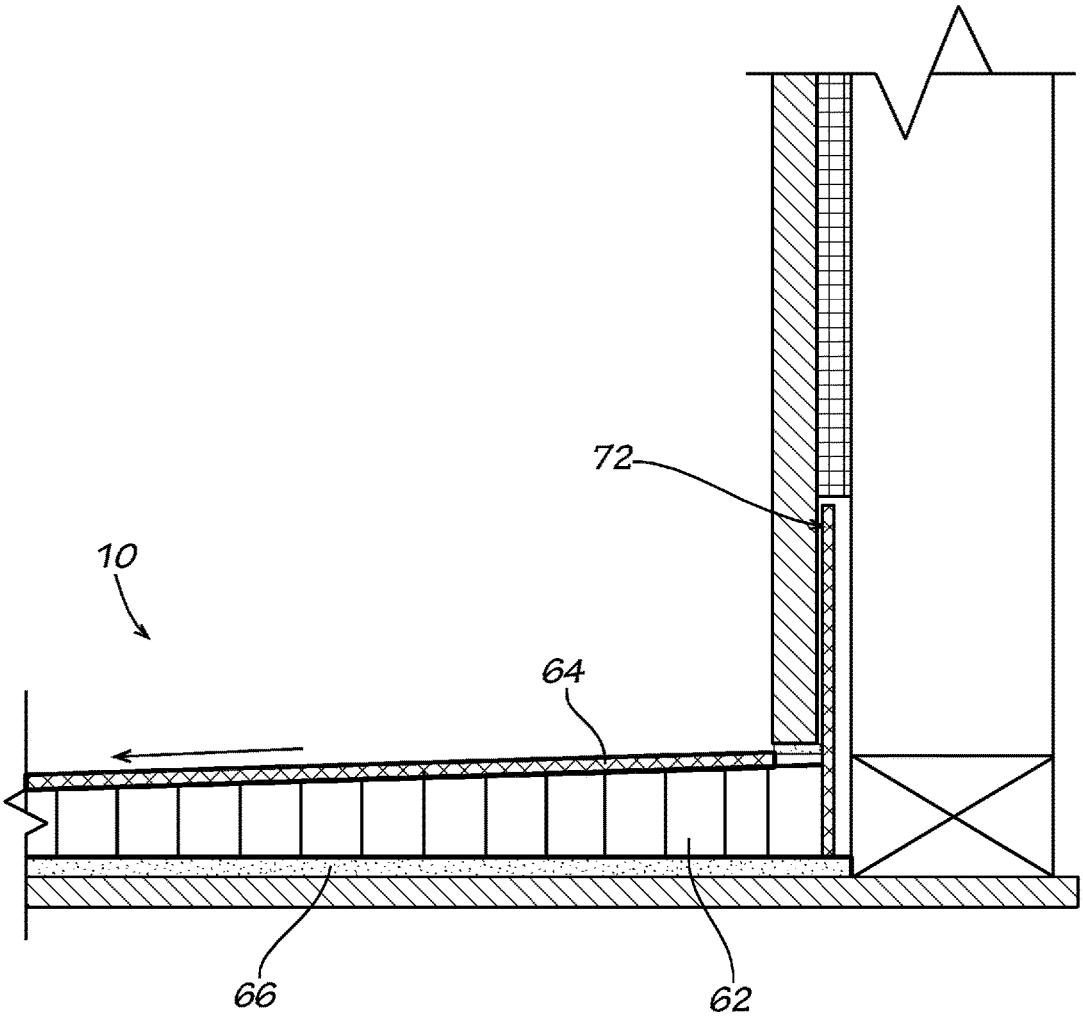

Optionally, the curb 40 supports a shower door, enclosure panel or other structure 52, and one or more fasteners 50 secure the structure to the curb (see FIGS. 1A, 3B). The anchoring cap portion 44 of the curb 40 is positioned at the top of the base portion 42 so that the fasteners 50 securing the shower enclosure 52 thereto engage and fasten into the anchoring portion 44.

FIG. 2 shows a cross-sectional view of the curb 40 installed with the shower base 10. An adhesive layer of polymer modified thin-set or construction mastic is applied onto the subfloor to secure the curb 40 and shower base 10 in position. A polyurethane sealant 46 is optionally applied between the curb 40 and the shower base 10. Further, an additional sealing layer is optionally provided over the interface between the shower base 10 and the curb 40 by applying a reinforcing fabric 47 along adjacent surfaces thereof. The shower base 10 and the curb 40 can then be covered with tile or other decorative surface materials and a shower enclosure or other structure 52 can be mounted by one or more fasteners to the anchoring member 44 of the curb 40.

FIG. 3B shows further detail of the curb 40 of the present invention installed around a shower basin 20, and covered with a decorative surface material (e.g., tile, acrylic sheet, cushion layer, etc.). As such, the shower enclosure 52 is secured to the curb 40 wherein the fasteners 50 engage an anchoring system (e.g., hardware) of the shower enclosure 52 and further extend through the decorative layer and into the anchoring cap 44 to secure the shower enclosure 52 to the curb 40.

In example embodiments, the basin 20 includes a first drain hole or recess 22 in the top surface of the basin to receive a standard tile drain 30 during installation, as seen in FIGS. 4-10. The drain recess 22 is about six inches in diameter, although the diameter of the recess can vary as desired or needed to accommodate a particular drain 30. The recess 22 preferably extends from the top surface of the basin 20 through the top waterproof layer 64 and at least partially through the EPS core 62, but not through the bottom waterproof layer or skin 66. A second drain hole 24 is axially aligned with the first hole or drain recess 22 and extends through the SSB 68 in its entirety, including through the bottom waterproof layer or skin 66. The second drain hole 24 is preferably about four inches in diameter, but can vary depending on the application. The recess and drain hole 22, 24 allow a clamping attachment mechanism 80 of a standard tile drain 30 to be used to couple the basin 20 to a drain body 82 installed in the sub-floor and connected to a standard interior or exterior plumbing drainpipe, as depicted in FIGS. 5-9D.

The shower base 10 is installed by cleaning and removing any debris from the sub-floor in the area that the shower base is to be installed. Latex modified thin-set mortar is applied to the substrate using a square or U-notched trowel (thin-set should be flush with the top edge of the drain body flange). A bead of 100% silicone adhesive is applied around the outside perimeter area of the tile drain body 82 to provide a watertight seal (see FIG. 9). The shower base 10 is lowered into place, and the shower base is solidly embedded in the mortar, and leveled to insure proper drainage. Optionally, an impermeable layer (e.g., ShowerSeal™) can be added above the thin-set prior to the installation of the shower base 10. Drain bolts are replaced, the clamping ring 80 installed, and the drain clamp bolts tightened to engage the bottom skin 66 of the shower base in the area of the recess 22. The drain top 30 is adjusted to the desired height, and latex modified thin-set is troweled into the area around the clamping ring 80. The shower base 10 is then ready to be tiled according to typical fashion. Because the basin 20 is directly coupled to the drain body 82, a watertight seal can readily be relied upon without the need for additional plumbing work, which is typically necessary with pre-made shower bases. Additionally, the shower base of the present invention enables use of a standard tile drain, without need for specialized parts or modification.

Figure 11:
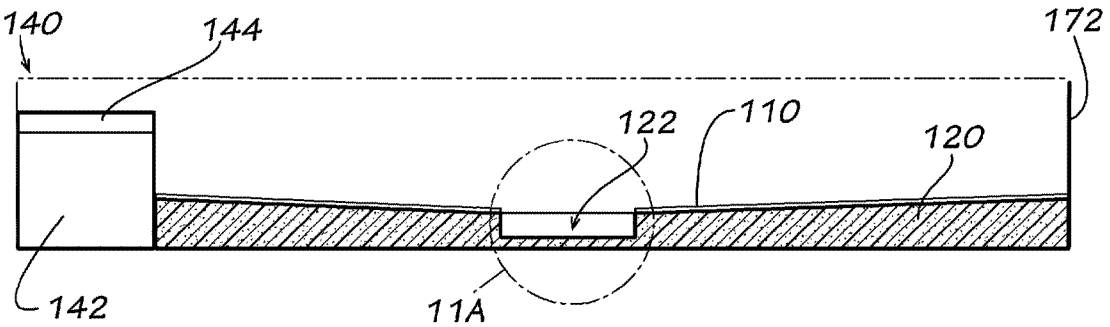
FIG. 11 is a side view of a cushioned shower base according to another example embodiment of the present invention.
Figure 11A:
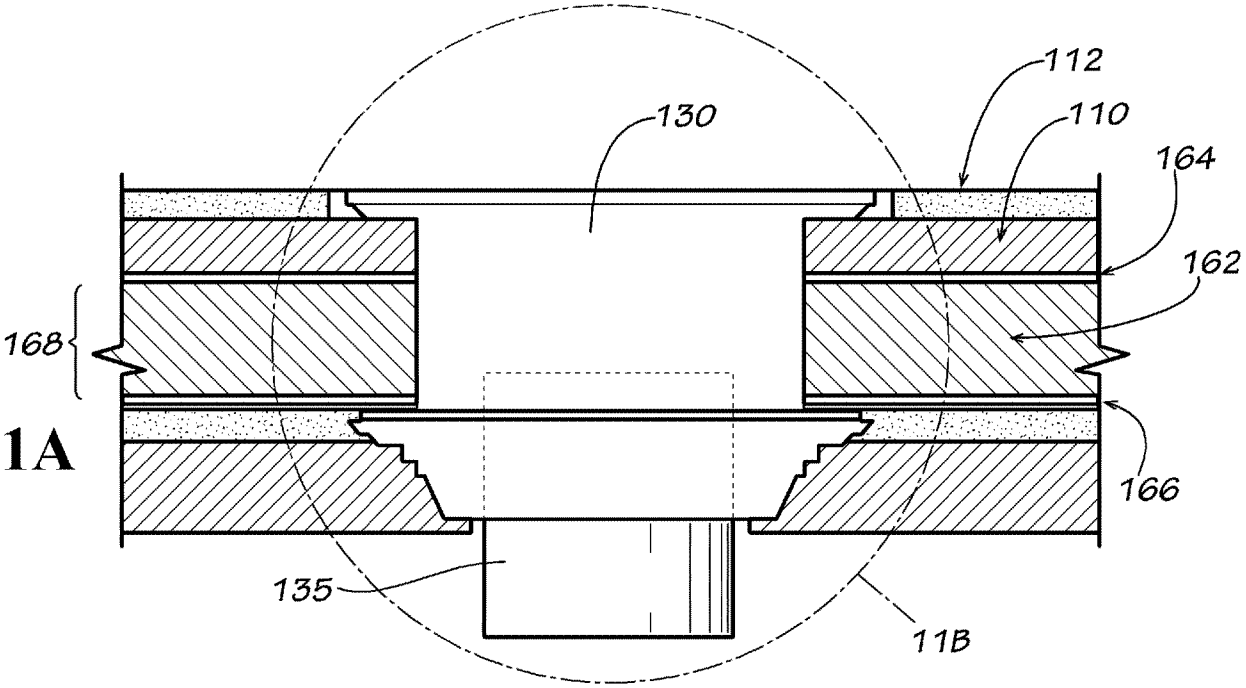
FIG. 11A is a close up view of the drain connection area of FIG. 11.

In additional example embodiments and as briefly described above, the shower base 10 can be in the form of a cushioned shower pan or drainage floor assembly 100, which generally comprises the shower base 10 as described above covered with a cushion layer 110, for example, by being laminated, adhered or otherwise attached to an exposed or top surface of the sloped core 120 or the SSB 168. In one form, as depicted in FIG. 11, the cushioned shower pan 100 generally comprises the cushioned EVA foam backing layer 110, a sloped EPS basin or core 120, a drain opening 122, an optional curb 140, and an optional perimeter flange 172. Preferably, a drain 130 is installed to create a watertight seal with a drain body 135 (e.g., 2" IPS pipe) that is installed below the sub-floor. As depicted in FIG. 11A, the cushioned shower pan or drainage floor assembly 100 may optionally comprise a plurality of additional layers (e.g., skins, backings, seals, caps, etc.) in addition to the cushioned layer 110 and the core 120. For example, in example embodiments and as similarly described above, an epoxy/mesh bottom skin 166 and an epoxy/mesh top skin 164 are applied to the sides of the EPS core 162 (forming the SSB 168), the cushioned layer 110 is applied to the epoxy/mesh top skin 164. Optionally, a pliable material or decorative/slip resistant EVA foam cap layer 112 can be applied to the cushioned layer 110.

Generally, the cushioned layer 110 substantially covers the entire sloped (top) surface of the shower base 100 and can optionally be attached to the exposed surfaces of the curb 140. In one example form, the cushion layer 110 is formed from ethylene-vinyl acetate (EVA) foam or other resilient water-resistant or waterproof material. In alternate forms, the cushion layer 110 can be formed from various other materials including closed cell foam, latex, neoprene, rubber, compressible plastics or other resilient natural or synthetic materials exhibiting flexibility, dampening and/or cushioning. In example forms, the cushion layer 110 provides a resilient surface for increased grip and comfort, and for dampening or injury-reducing effect to substantially reduce the likelihood of injury due to accidentally falling or slipping thereon. In example embodiments, the cushioned layer 110 may be applied and attached to the SSB 168 at a manufacturing facility and delivered to the job site as a ready to install assembly; or alternatively can be applied and attached at the jobsite, either before or after installation of the core onto the shower subfloor.

Figure 11B:
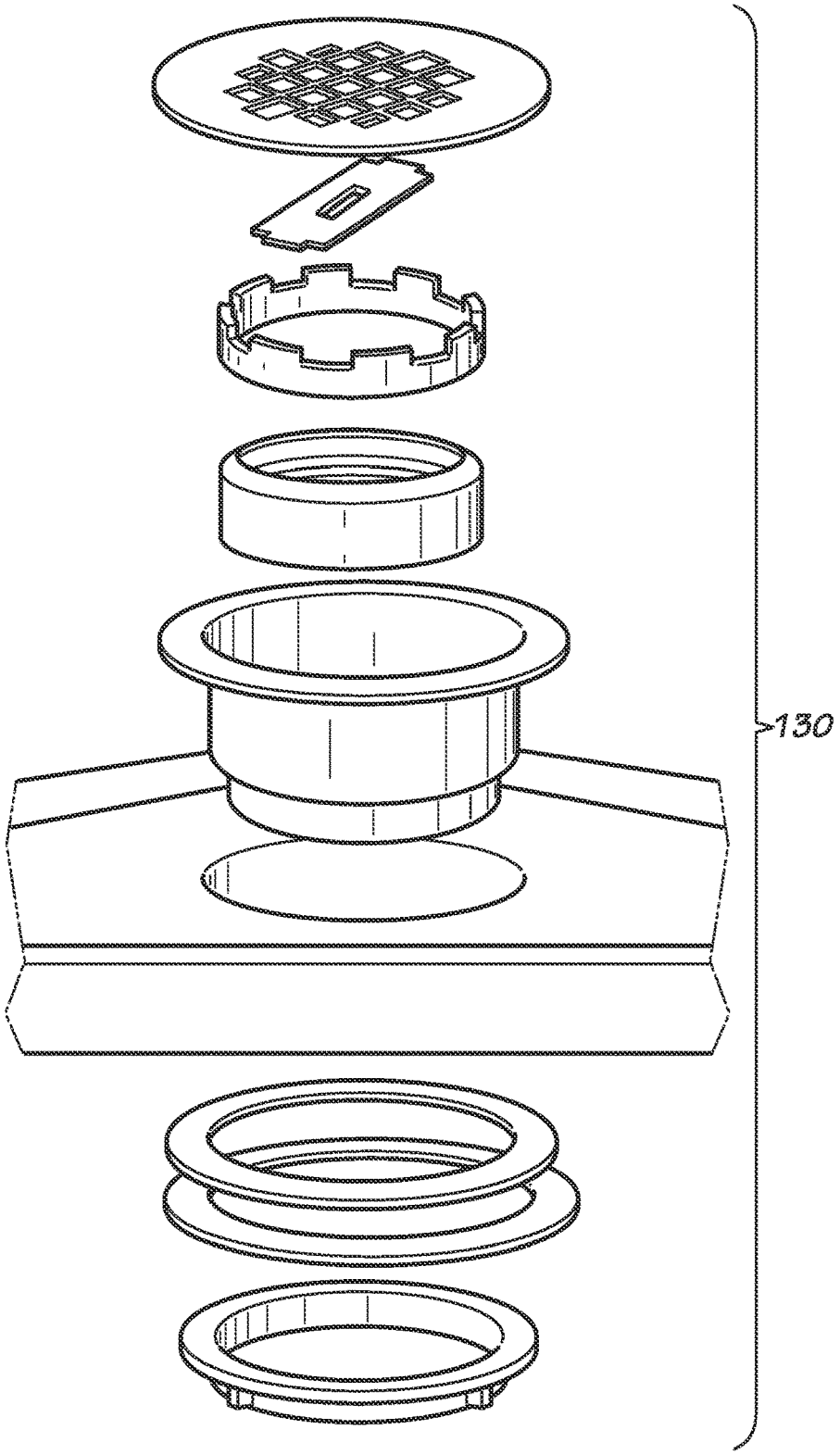
FIG. 11B is an exploded view of the drain of FIG. 11A.

In example methods of use, the cushioned shower pan or drainage floor assembly 100 can be installed by troweling an adhesive layer of polymer modified thin-set or construction mastic to the sub-floor area where the cushioned shower pan 100 is to be installed. Optionally, the impermeable layer (e.g., ShowerSeal™) can be added above the thin-set prior to the installation of the sloped basin 120. The sloped basin 120 is then installed over the thin-set and/or the impermeable layer. The drain 130 is installed and attached through the drain opening 122, for example as shown in FIG. 11B, to provide a watertight seal with the sloped basin. A caulk or silicone sealant may optionally be applied around the perimeter of the drain 130 to provide a watertight seal.

Figure 12:
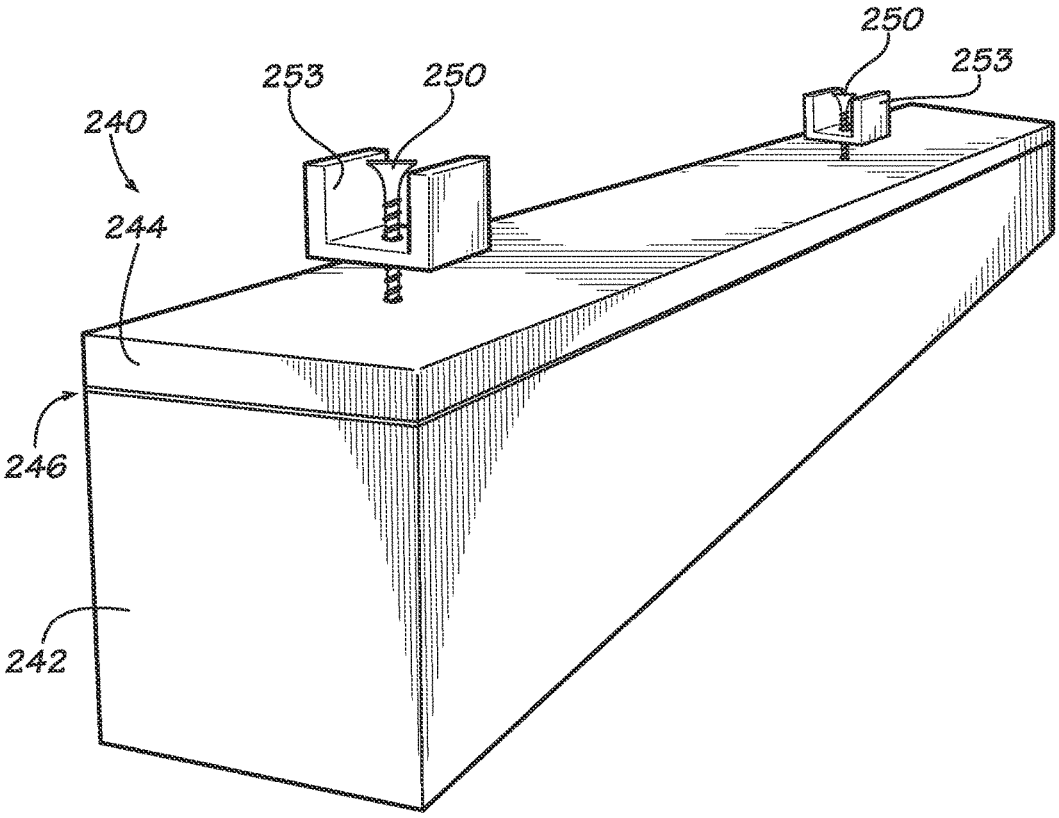
FIG. 12 is a perspective view of a curb according to another example embodiment of the present invention.
Figure 13:
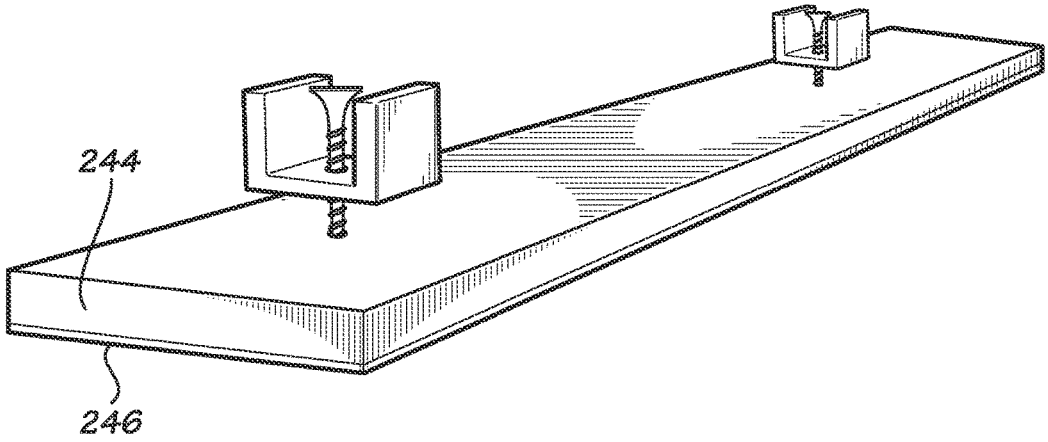
FIG. 13 is a perspective view of a cap for attachment to a curb according to another example embodiment of the present invention.
Figure 14:
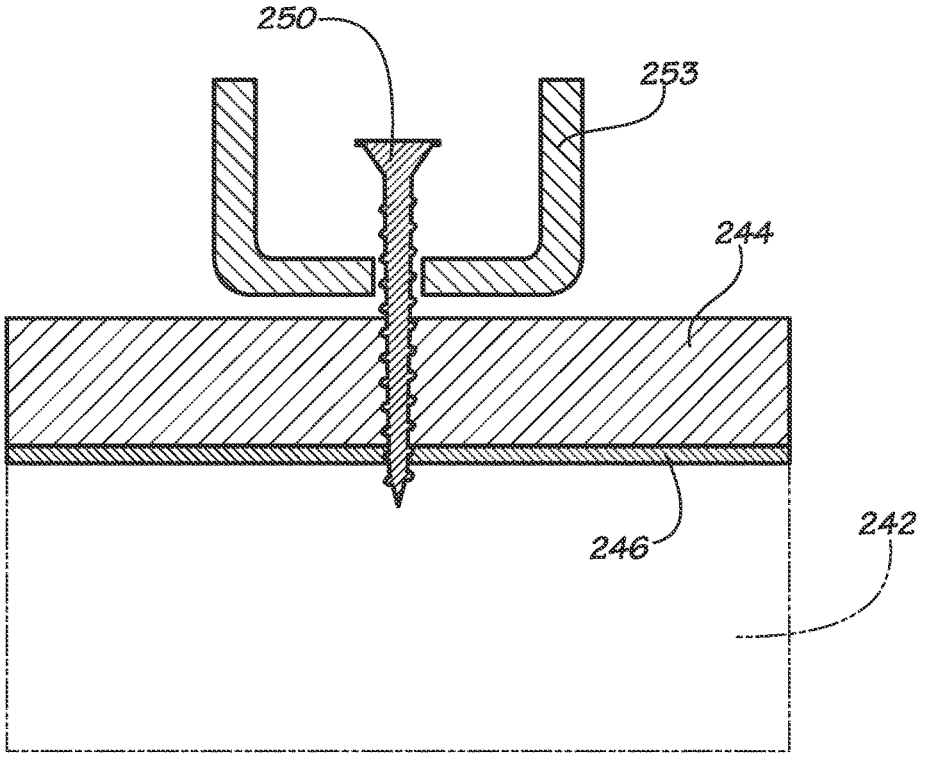
FIG. 14 is a cross-sectional view of the cap of FIG. 13.

FIGS. 12-14 show further details of a shower curb 240 and a curb cap 244 according to additional embodiments of the invention. As depicted in FIG. 12, the shower curb 240 is generally similar to the shower curbs 40, 140 as described above, for example comprising a lower density closed cell foam base portion 242 and a higher density polymeric anchoring cap portion 244. The curb may be utilized in combination with a fabricated waterproof base and drain assembly as a component of an overall shower system, or independently in various other applications such as with site-formed shower bases. Optionally, a self-sealing membrane, sealant, adhesive or flashing layer or member 246 is positioned between the base portion 242 and the anchoring cap portion 244. According to example forms, the self-sealing flashing layer or member 246 provides a water-tight, self-sealing seal with fasteners 250 such as screws used to engage the anchoring system (e.g., hardware) of a shower enclosure, for example, wherein the fasteners 250 extend through the decorative tile layer (not shown), through the anchoring cap 244 and the self-sealing flashing layer or member 246, and into the base portion 242 to secure the shower enclosure to the curb 240. In example forms, the self-sealing flashing layer or member 246 can comprise a rubberized asphalt, a butyl, rubber or polyurethane flashing or adhesive, and/or a modified bitumen material. Thus, even if the fasteners 250 penetrate the anchoring cap 244, the self-sealing flashing layer or member 246, and the base portion 242, the self-sealing flashing layer or member 246 forms a waterproof seal with the fastener 250 such that water is prevented from migrating along the fastener into the base portion of the curb 240. Optionally, the self-sealing flashing layer or member 246 comprises an adhesive bonding the anchoring cap 244 to the base portion 242. In further embodiments, the shower curb 240 and/or the anchoring cap 244 optionally further comprise a coating, cladding or exterior shell or layer having a surface texture or material characteristics for improved adhesion of tile grout or surface adhesive to better hold an outer covering of tile or other surface treatment material. For example, an elastomeric waterproofing membrane can optionally be applied per ANSI 118.10 standards, to waterproof and seal any porous materials of the curb and/or cap, to prime the curb/cap to receive thin-set mortar or grout, and/or to provide the component with improved crack-isolation properties.

FIGS. 13 and 14 show an anchoring cap 244 in example form, independent of the composite curb base 242. The anchoring cap 244 may be used in combination with a curb base as described above, or alternatively can be used independently for other applications, for example as a cap for other types of curb constructions (e.g., wood, concrete, mortar or other materials), an entry threshold, anchoring panel or other structural component. In example forms, the anchoring cap 244 is a generally rectangular panel having a thickness of between ¼"-1½", for example about ½" (0.5 inch) thick, a width of between 1"-12", for example about 3½" (3.5 inches) wide, and may be formed from polyvinyl chloride (PVC), closed-cell PVC foam board, acrylonitrile butadiene styrene (ABS), polyethylene, polypropylene, polystyrene, acrylic, and/or other materials of construction. Optionally, a self-sealing flashing layer or member 246, as described above, is applied on at least a portion of the lower face of the anchoring cap 244.

In an example method of use, a fastener 250 is installed through a U-shaped anchor bracket 253 (such as for mounting a shower enclosure or door), and into or through the anchoring cap portion 244, optionally through the self-sealing flashing member 246 (if present), and optionally into the foam curb base portion 242 or other underlying structure (e.g., foam, wood, concrete, mortar, or other materials). The material of the anchoring cap 244 preferably has a sufficient degree of resilience to be at least partially self-healing and to form a substantially waterproof seal with the threads of a screw or other fastener that is installed into the anchoring cap, to prevent water from migrating along the fastener and through the anchoring cap. Additionally or alternatively, if provided, the optional self-sealing member 246 provides an additional measure of sealing with the fastener. Optionally, an adhesive is provided along at least one surface of the anchoring cap for attachment of the anchoring cap to a substrate or structure. In additional example embodiments, the anchoring cap portion 244 (optionally including the self-sealing member 246 affixed thereto) may be assembled on-site with a desired base portion, and the exposed side of the self-sealing member 246 may be provided with a release sheet or covering to minimize exposure of the adhesive prior to affixing the anchoring cap portion 244 to the intended substrate or structure. Alternatively or additionally, a separate adhesive or glue may be applied to the exposed side of the self-sealing member 246 prior to installation atop the desired base portion 242.

The present invention therefore includes a tile-ready shower curb and/or anchoring cap permitting anchoring of a shower enclosure or other structure, and providing a waterproof or water-resistant connection. The invention also includes a tile-ready shower base apparatus 10 and a cushioned shower pan apparatus 100, both of which do not have many of the problems typically associated with a tiled shower basin, a method of manufacturing or fabricating such apparatus, and a method of installing such apparatus.

While the invention has been described with reference to preferred and example embodiments, it will be understood by those skilled in the art that a variety of modifications, additions and deletions are within the scope of the invention, as defined by the following claims.

What is claimed is:

1. A prefabricated composite shower curb for positioning along at least one side of a shower base, the prefabricated composite shower curb comprising a lower density base portion, a higher-density anchoring cap portion, and a self-sealing layer between the lower density base portion and the higher-density anchoring cap portion, the base portion comprising a lightweight expanded foam body defining a height and a width, the anchoring cap portion comprising a fastener retaining polyvinyl chloride material and having a width substantially matching the width of the base portion, wherein the anchoring cap portion is substantially permanently attached to the base portion by the self-sealing layer; and wherein the anchoring cap portion and the self-sealing layer prevent water from migrating into the base portion along a fastener installed through the anchoring cap portion and the self-sealing layer.

2. The prefabricated composite shower curb of claim 1, wherein a side of the high-density anchoring cap portion is substantially permanently attached to a first side of the self-sealing layer, and wherein a side of the base portion is substantially permanently attached to a second side of the self-sealing layer, thereby substantially permanently attaching the high-density cap portion to the base portion.

3. The prefabricated composite shower curb of claim 1, wherein the self-sealing layer comprises a butyl, rubber, rubberized asphalt, modified bitumen, or polyurethane sealant or adhesive.

4. The prefabricated composite shower curb of claim 1, wherein the self-sealing layer comprises a butyl, rubber, rubberized asphalt, modified bitumen, or polyurethane flashing material.

5. The prefabricated composite shower curb of claim 1, further comprising an elastomeric waterproofing layer applied to at least a portion of the curb.

6. The prefabricated composite shower curb of claim 1, wherein the lightweight expanded foam body of the curb comprises a closed-cell foam.

7. The prefabricated composite shower curb of claim 6, wherein the closed-cell foam comprises expanded polystyrene.

8. The prefabricated composite shower curb of claim 1, further comprising a sealant applied over external surfaces of at least the base portion.

9. The prefabricated composite shower curb of claim 8, wherein the sealant is compatible with a thinset adhesive grout.

* * * * *